US006054238A

United States Patent [19]

Little et al.

[11] Patent Number: 6,054,238

[45] **Date of Patent: *Apr. 25, 2000**

[54] TONERS CONTAINING POSITIVELY CHARGEABLE MODIFIED PIGMENTS

[75] Inventors: Charles B. Little, Champaign, Ill.; James A. Belmont, Acton, Mass.

[73] Assignee: Cabot Corporation, Boston, Mass.

[ * ] Notice: This patent is subject to a terminal disclaimer.

[21] Appl. No.: 09/119,007

[22] Filed: Jul. 20, 1998

Related U.S. Application Data

[63] Continuation-in-part of application No. 08/897,446, Jul. 22, 1997, Pat. No. 5,955,232.

[51] Int. Cl.[7] ..... G03G 9/09; G03G 13/22

[52] U.S. Cl. ..... 430/106; 430/110; 430/120

[58] Field of Search ..... 430/106, 110, 430/126, 120

[56] References Cited

U.S. PATENT DOCUMENTS

| | | | |
|---|---|---|---|
| 3,968,044 | 7/1976 | Tamai et al. | 252/429 |
| 4,291,112 | 9/1981 | Lu | 430/110 |
| 4,618,556 | 10/1986 | Takenouchi | 430/110 |
| 4,640,882 | 2/1987 | Mitsuhashi et al. | 430/110 |
| 4,902,570 | 2/1990 | Heinemann et al. | 428/405 |
| 5,024,915 | 6/1991 | Sato et al. | 430/106.6 |
| 5,116,712 | 5/1992 | Nakamura et al. | 430/106 |
| 5,147,749 | 9/1992 | Alexandrovich et al. | 430/110 |
| 5,270,770 | 12/1993 | Kukimoto et al. | 355/274 |
| 5,275,900 | 1/1994 | Ong et al. | 430/108 |
| 5,278,018 | 1/1994 | Young et al. | 430/108 |
| 5,281,261 | 1/1994 | Lin | 106/20 R |
| 5,434,030 | 7/1995 | Smith et al. | 430/106 |
| 5,484,575 | 1/1996 | Steenackers | 422/176 |
| 5,484,675 | 1/1996 | Tripp et al. | 430/106 |
| 5,486,420 | 1/1996 | Nishihara et al. | 428/405 |
| 5,510,221 | 4/1996 | Matalevich et al. | 430/106.6 |
| 5,534,981 | 7/1996 | Ohno et al. | 355/245 |
| 5,554,739 | 9/1996 | Belmont | 534/885 |
| 5,561,018 | 10/1996 | Moriya | 430/106.6 |
| 5,571,654 | 11/1996 | Ong | 430/110 |
| 5,630,868 | 5/1997 | Belmont et al. | 106/31.75 |
| 5,654,357 | 8/1997 | Menashi et al. | 524/495 |
| 5,672,198 | 9/1997 | Belmont | 106/20 R |
| 5,679,728 | 10/1997 | Kawazura et al. | 523/215 |
| 5,695,899 | 12/1997 | Kamada et al. | 430/106 |
| 5,698,016 | 12/1997 | Adams et al. | 106/316 |
| 5,707,432 | 1/1998 | Adams et al. | 106/31.6 |
| 5,713,988 | 2/1998 | Belmont et al. | 106/31.6 |
| 5,749,950 | 5/1998 | Mahmud et al. | 106/316 |

FOREIGN PATENT DOCUMENTS

| | | |
|---|---|---|
| 0 718 707 A1 | 6/1996 | European Pat. Off. . |
| 0 718 709 A1 | 6/1996 | European Pat. Off. . |
| 0 720 066 A1 | 7/1996 | European Pat. Off. . |
| 0 723 206 A1 | 7/1996 | European Pat. Off. . |
| 1-567760 | 6/1989 | Japan . |
| 3-197961 | 8/1991 | Japan . |
| 3-197972 | 8/1991 | Japan . |
| WO 92/13983 | 8/1992 | WIPO . |
| WO 96/18688 | 6/1996 | WIPO . |
| WO 97/09655 | 3/1997 | WIPO . |
| WO 97/47382 | 12/1997 | WIPO . |
| WO 97/47691 | 12/1997 | WIPO . |
| WO 97/47692 | 12/1997 | WIPO . |
| WO 97/47697 | 12/1997 | WIPO . |
| WO 97/47698 | 12/1997 | WIPO . |
| WO 98/13418 | 4/1998 | WIPO . |
| WO 98/13428 | 4/1998 | WIPO . |

OTHER PUBLICATIONS

International Search Report for PCT/US98/15450.

*Primary Examiner*—John Goodrow

[57] ABSTRACT

A toner composition is disclosed which contains modified pigment particles having attached organic groups and styrenic polymer-based resin particles. The organic groups which are attached to the pigment particles are positively chargeable. Developer compositions containing the toner compositions of the present invention and methods of imaging are also described which use the toner compositions of the present invention.

27 Claims, 2 Drawing Sheets

TONERS CONTAINING POSITIVELY CHARGEABLE MODIFIED PIGMENTS

This application is a continuation-in-part of prior application Ser. No. 08/897,446 filed Jul. 22, 1997 now U.S. Pat. No. 5,955,232.

BACKGROUND OF THE INVENTION

1. Field of the Invention

The present invention relates to toner and developer compositions containing positively chargeable modified pigments.

2. Discussion of the Related Art

Electrophotographic processes and image-forming apparatus are widespread nowadays. Particularly, aspects of the xerographic process are set forth in R. M. Schaffert "Electrography", the Focal Press, London & N.Y., enlarged and revised edition, 1975. In electrophotography, an image comprising an electrostatic field pattern (also referred to as an electrostatic latent image), usually of nonuniform strength, is formed on an insulative surface of an electrophotographic element. The insulative surface comprises a photoconductive layer and an electrically conductive substrate. The electrostatic latent image may be formed by imagewise photo-induced dissipation of the strength of portions of an electrostatic field of uniform strength previously formed on the insulative surface. Typically, the electrostatic latent image is then visualized by contacting the latent image with an oppositely charged toner powder generally containing a colorant. This process of visualization of a latent image is known as development, and the composition containing the dry toner powder is known as the developer. The toned image is then transferred onto a transfer medium such as paper and fixed thereon by heating and/or pressure. The last step involves cleaning residual toner from the electrophotographic element.

Developer compositions used in dry electrophotography to visualize latent electrostatic images are divided into one-component systems composed of a dry toner powder, generally including a binder resin having a colorant dispersed therein, and two-component systems composed of a dry toner powder and carrier particles. Charge control agents are often melt mixed with the toner resin to control the chargeability of the toner during use. Known positive charge controlling compounds for use in dry toners are dye bases and salts thereof such as nigrosine dye base and salts. In order that toner compositions have process suitability in copying, they are required to be excellent in fluidity, anti-caking properties, fixability, chargeability, cleaning properties, and the like. To improve these properties, particularly fluidity, anti-caking properties, and chargeability, extraparticulate inorganic fine particles are frequently added to toner compositions. The components of the toner are dispersed or dissolved in the toner resin vehicle during the compounding step of the preparation process. The degree of dispersion has an effect on the performance of the toner material in the printing process. Inadequate dispersion can in many instances lead to a lack of consistency of homogeneity in the toner particle to particle. This can lead to a broad spread in charge distribution of the toner because of the dissimilarity of composition of the particulate toner. The electrostatic printing process is best performed when the toner used has a uniform charging behavior which will minimize the occurrence of print defects such as fogging, background, haloing, character spread, and dust contamination of the internal parts of the printing apparatus.

Development of a latent electrostatic image requires that a charge be developed on the toner particles prior to their deposition on the latent image, and that this charge be opposite to the charge of the latent image. All components of a toner, including binder resin, colorants, charge control agents, waxes and the like, can influence the development of charge on the toner particles. The influence of the colorants on the charging behavior of toner compositions is seldom considered, as there are few known methods to change and control the natural charging behavior of colorants such as carbon black. Thus an unmet need in dry toner technology is for pigments which have certain unique and predictable tribocharging properties.

One approach to meeting this need is to surface-modify known pigments to enhance or change their natural tribocharging properties. For example, Japanese Patent Application Hei 3[1991]-197961 relates to surface treatment of carbon blacks with amine-functional silane coupling agents which can, to some extent, overcome the natural tendency of carbon blacks to tribocharge negatively, which makes the carbon blacks more useful as pigments in positive-charging toners. However, it is believed that for such treatments to be effective, the silane coupling agents must form a covalent bond to the surface of the carbon black. The chemical groups believed to be present on the surface of normal carbon black are oxygen-containing groups. Silane coupling agents can form covalent bonds with these groups. Such groups are normally present on the surface of carbon black at low and poorly-controlled levels, making such treatment with silane coupling agents of limited scope and value.

SUMMARY OF THE INVENTION

A feature of the present invention is to provide alternative additives which impart or assist in imparting a positive charge to the toner particles in toner and developer compositions.

Another feature of the present invention is to provide a colorant for use in toner and developer compositions.

Additional features and advantages of the present invention will be set forth in part in the description which follows, and in part will be apparent from the description, or may be learned by practice of the present invention. The objectives and other advantages of the present invention will be realized and attained by means of the elements and combinations particularly pointed out in the written description and appended claims.

To achieve these and other advantages and in accordance with the purpose of the present invention, as embodied and broadly described herein, the present invention relates to a toner composition which includes styrenic polymer-based resin particles and modified pigment particles which have at least one organic group attached to the pigment particles, wherein the organic group is positively chargeable.

The present invention also relates to a developer composition which includes carrier particles and the toner composition described above.

In addition, the present invention further relates to a method of imaging which includes the steps of formulating an electrostatic latent image on a negatively charged photoconductive imaging member, effecting the development thereof with a toner composition which includes styrenic polymer-based resin particles and modified pigment particles having attached an organic group that is positively chargeable, and thereafter transferring the developed image onto a suitable substrate.

It is to be understood that both the foregoing general description and the following detailed description are exemplary and explanatory only and are intended to provide further explanation of the present invention, as claimed.

DETAILED DESCRIPTION OF THE INVENTION

Figure 1:
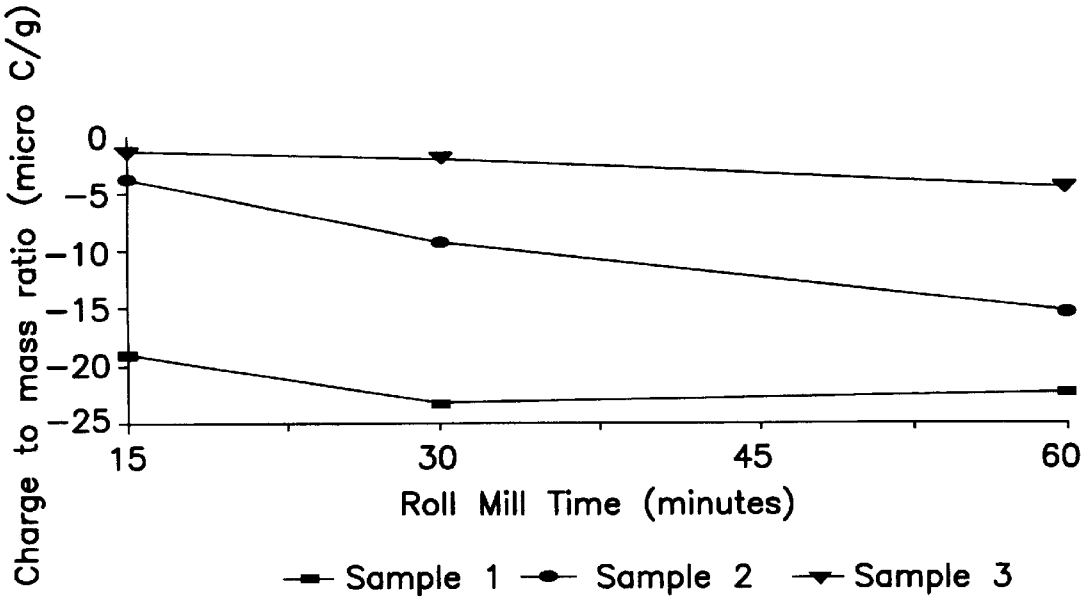
FIG. 1 is a graph (Q/M vs Roll Mill Time) showing the tribocharging behavior of dry powders, including a toner of the present invention, using a standard carrier.

The present invention relates to toner and developer compositions which include modified pigment particles having attached at least one organic group that is positively chargeable, and styrenic polymer-based resin particles.

The pigment particles that are modified can be carbon black, cyan, magenta, yellow, blue, green, brown, violet, red, or mixtures thereof. Suitable pigments are pigment particles capable of being modified with attachment of at least one organic group that is positively chargeable. Carbon black is the preferred pigment and examples include, but are not limited to, commercially available forms of carbon black, such as Regal® carbon black from Cabot Corporation. Pigments which may be capable of being modified are described, for instance, in U.S. Pat. Nos. 5,484,675; 5,571,654; 5,275,900; and EP 0 723 206 A1, all incorporated in their entirety by reference herein. As the pigment for black toner compositions, carbon black pigments alone or in combination with blue, green, magnetite or black dyes can be used.

The modified pigment has at least one organic group attached to the pigment particles and the organic group is positively chargeable. The organic group can be attached to the pigment in varying amounts, i.e., low to high amounts, thus allowing fine control over charge modification. The organic group that is attached to the pigment particles can be any group which permits the modified pigment to be positively chargeable once incorporated into the toner or developer composition. Preferably, the organic group comprises an aromatic group or a $C_1$–$C_{20}$ alkyl group, wherein either group can be substituted or unsubstituted. It is also preferred that the aromatic group or $C_1$–$C_{20}$ alkyl group is directly attached to the pigment particles. Preferred groups of positively chargeable organic groups are nitrogen containing or phosphorus containing organic groups.

Preferred positive chargeable organic groups have the general structures:

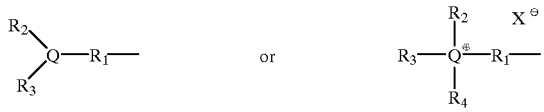

wherein Q represents the elements nitrogen or phosphorus; X represents a counterion such as $NO_3^-$, $Cl^-$, $Br^-$, $ArSO_3^-$, $CoCl_4^{2-}$, benzoate, and the like—or can be a counterion described in U.S. Pat. No. 5,645,967, incorporated in its entirety herein by reference; $R_1$ represents an alkylene group or an arylene group attached to the pigment; and $R_2$, $R_3$, and $R_4$, which may be the same or different, each represent an alkyl group or an aryl group. Two or more of the R groups can form one or more aliphatic and/or aromatic ring(s), such as $QR_2R_3R_4$ can form a pyridinium structure and $R_1$ can be phenylene. The ring can include one or more hetero elements. Preferably, the alkylene or alkyl group is a $C_1$–$C_{10}$ alkylene or alkyl group and the arylene or aryl group is a $C_6$–$C_{20}$ arylene or aryl group. For the purposes of this invention, aryl and arylene groups include heteroaryl and heteroarylene groups, respectively.

Other preferred organic groups that can be attached to the pigment particles include, but are not limited to the following:

| | |
|---|---|
| $(C_4H_9)NHCH_2CH_2CH_2$— | $NH_2CH_2CH_2$— |
| $(C_4H_9)_2NCH_2CH_2CH_2$— | $NH_2CH_2CH_2CH_2$— |
| $(C_8H_{17})NHCH_2CH_2CH_2$— | $NH_2CH_2CH_2CH_2CH_2$— |
| $(CH_8H_{17})_2NCH_2CH_2CH_2$— | $NH_2CH_2CH_2CH_2CH_2CH_2$— |
| $ArNHCH_2CH_2$— | $NH_2CH_2CH_2NHCH_2CH_2CH_2$— |
| $ArNHCH_2CH_2CH_2$— | $NH_2CH_2CH_2NHCH_2CH_2CH_2NHCH_2CH_2CH_2$— |
| $ArNHCH_2CH_2CH_2CH_2$— | $(CH_3)NHCH_2CH_2CH_2$— |
| $ArNHCH_2CH_2CH_2CH_2CH_2$— | $(CH_3)_2NHCH_2CH_2CH_2$— |
| $ArAr'NHCH_2CH_2$— | $(C_2H_5)NHCH_2CH_2CH_2$— |
| $ArAr'NCH_2CH_2CH_2$— | $(C_2H_5)_2NCH_2CH_2CH_2$— |
| $ArAr'NCH_2CH_2CH_2CH_2$— | —$C_6H_4(NC_5H_5)^+X^-$ (as defined above) |
| $ArAr'NCH_2CH_2CH_2CH_2CH_2$— | —$C_5H_4N(CH_3)^+X^-$ (as defined above) |
| $NH_2CONHCH_2CH_2CH_2$— | |
| $(CH_3)HCONHCH_2CH_2CH_2$— | |
| $(CH_3)_2NCONHCH_2CH_2CH_2$— | |

-continued

| | |
|---|---|
| $(C_2H_5)NHCONHCH_2CH_2CH_2$— | —Ar—$SO_2NH(C_4H_3N_2)$ |
| $(C_2H_5)_2NCONHCH_2CH_2CH_2$— | |
| $(C_4H_9)NHCONHCH_2CH_2CH_2$— | |
| $(C_4H_9)_2NCONHCH_2CH_2CH_2$— | |
| $CH_3OCOCH_2CH_2NHCH_2CH_2CH_2$— | |
| $(C_2H_5)OCOCH_2CH_2NHCH_2CH_2CH_2$— | |
| $(C_4H_9)OCOCH_2CH_2NHCH_2CH_2CH_2$— | |
| $NH_2Ar$— | |
| $(CH_3)NHAr$— | |
| $(CH_3)_2NAr$— | |
| $NH_2CH_2Ar$— | |
| $(CH_3)_2NCH_2Ar$— | |
| $(CH_3)_2NCH_2CH_2Ar$— | |
| $NH_2CH_2CH_2Ar$— | |
| $(CH_3)NHCH_2CH_2Ar$— | |
| $(CH_3)_2NCH_2CH_2Ar$— | |
| $Cl^-(CH_3)_3N^+CH_2CH_2CH_2$— | |
| $Cl^-(C_2H_5)_3N^+CH_2CH_2CH_2$— | |
| $Cl^-(C_4H_9)_3N^+CH_2CH_2CH_2$— | |
| $Cl^-(C_2H_5)(CH_3)_2N^+CH_2CH_2CH_2$— | |
| $Cl^-(C_4H_9)(CH_3)_2N^+CH_2CH_2CH_2$— | |
| $Cl^-(C_8H_{17})(CH_3)_2N^+CH_2CH_2CH_2$— | |
| $(HOCH_2CH_2)_2NCH_2CH_2CH_2$— | |
| $(HOCH_2CH_2)_2NAr$— | |

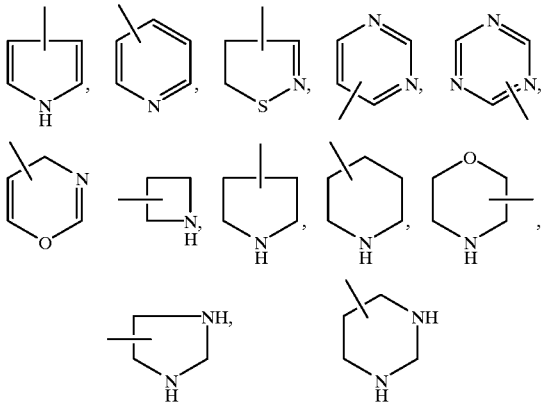

in which Ar represents an aromatic group and Ar' represents an aromatic group. The aromatic group includes, but is not limited to, unsaturated cyclic hydrocarbons containing one or more rings. The aromatic group may be substituted or unsubstituted. Aromatic groups include aryl groups (or example, phenyl, naphthyl, anthracenyl, and the like), and heteroaryl groups (imidazolyl, pyrazolyl, pyridinyl, thienyl, thiazolyl, furyl, triazinyl, indolyl, and the like).

A combination of organic groups such as an organic group comprising a pyridyl group and an organic group comprising a quaternary ammonium group can be used.

As described earlier, one or more organic groups can be attached to the pigment. Also, a modified pigment with untreated pigment(s), such as conventional carbon black, can be used in the toner composition. Further, two or more modified pigments, each having a different organic group attached to the pigment, can be used. In addition, any combination of the above can be used in the toner compositions of the present invention.

As shown in the examples, various loading levels of the pigment and treatment levels can be used. Certain modified pigments are preferably used at lower levels, while other modified pigments are preferably used at higher levels in the toner compositions.

The following discussion is with reference to the modification of the preferred pigment, carbon black. However, modified pigments other than carbon black can be similarly prepared. The modified carbon black may be prepared preferably by reacting carbon with a diazonium salt in a liquid reaction medium to attach at least one organic group to the surface of the carbon. The diazonium salt may contain the organic group to be attached to the carbon. A diazonium salt is an organic compound having one or more diazonium groups. Preferred reaction media include water, any medium containing water, and any medium containing alcohol. Water is the most preferred medium. Examples of modified carbon black and various preferred methods for their preparation are described in U.S. patent application Ser. No. 08/356,660 entitled "Reaction of Carbon Black with Diazonium Salts, Resultant Carbon Black Products and Their Uses," filed Dec. 15, 1994 and its continuation-in-part application, U.S. patent application Ser. No. 08/572,525, filed Dec. 14, 1995, U.S. Pat. No. 5,554,739 entitled "Reaction of Carbon Materials With Diazonium Salts and Resultant Carbon Products," WO 96/18696 and WO 96/18688, all incorporated herein by reference.

In the preferred preparation of the above modified carbon black, the diazonium salt need only be sufficiently stable to allow reaction with the carbon. Thus, that reaction can be carried out with some diazonium salts otherwise considered to be unstable and subject to decomposition. Some decomposition processes may compete with the reaction between the carbon and the diazonium salt and may reduce the total number of organic groups attached to the carbon. Further, the reaction may be carried out at elevated temperatures where many diazonium salts may be susceptible to decomposition. Elevated temperatures may also advantageously increase the solubility of the diazonium salt in the reaction medium and improve its handling during the process. However, elevated temperatures may result in some loss of the diazonium salt due to other decomposition processes. The diazonium salts may be prepared in situ. It is preferred that the modified carbon black of the present invention contain no by-products or unattached salts.

With respect to suitable toner resins for use in the toner and developer compositions of the present invention, a styrenic polymer-based is used, such as a styrenated acrylic resin. Examples of preferred styrenic polymer-based resins include, but are not limited to, homopolymers and copolymers of styrene and its derivatives such as: polystyrene; poly-p-cholorostyrene; polyvinyltoluene; styrene-p-chlorostyrene copolymer; and styrene-vinyltoluene copolymer; copolymers of styrene and acrylic acid esters such as: styrenemethylacrylate copolymer; styrene-ethylacrylate copolymer; and styrene-n-butyl acrylate copolymer; copolymers of styrene and methacrylic acid esters such as: styrene-methyl methacrylate copolymer; styrene-ethyl methacrylate copolymer; styrene-n-butyl methacrylate copolymer; and multi-component copolymers of styrene, acrylic acid ester and methacrylic acid esters; copolymers of styrene and other vinyl monomers such as: styrene-acrylonitrile copolymer, styrene-methyl ether copolymer; styrene-butadienee copolymer; styrene-vinyl methyl ketone copolymer; styrene-acrylonitrileindene copolymer; styrene maleic acid ester copolymer; and the like. These binder resins may be used singly or in combination. Generally, resins particularly suitable for use in xerographic toner manufacturing have a melting point (ring and ball method) in the range of 100° C. to 135° C. and have a glass transition temperature (Tg) greater than about 60° C. Examples of styrenic polymer-based resin particles and suitable amounts can also be found in U.S. Pat. Nos. 5,278,018; 5,510,221; 5,275,900; 5,571,654; 5,484,575; and EP 0 270 066 A1, all incorporated in their entirety by reference herein.

Generally, the modified pigment of the present invention, alone or with other pigments, is present in total amounts of from about 1% by weight to about 30% by weight of the toner or developer composition. The amount of pigment present in the toner composition is preferably from about 0.1 to about 12 wt parts per 100 wt parts of resin. However, lesser or greater amounts of the modified pigment may be used. Also, generally, the toner resin is present in amounts of from about 60% by weight to about 99% by weight of the toner or developer composition.

Optional external additives may also be mixed or blended with the toner compositions of the present invention including carrier additives; additional positive or negative charge controlling agents such as quaternary ammonium salts, pyridinum salts, sulfates, phosphates, and carboxylates; flow aid additives; silicone oils; waxes such as commercially available polypropylenes and polyethylenes; magnetite; and other known additives. Generally, these additives are present in amounts of from about 0.05% by weight to about 30% by weight, however, lesser or greater amounts of the additives may be selected depending on the particular system and desired properties. Specific examples of additives and amounts are also described in the patents and the European patent application mentioned above and incorporated herein by reference.

The toner compositions can be prepared by a number of known methods, such as admixing and heating the resin, the modified pigment particles, optional charge enhancing additives and other additives in conventional melt extrusion devices and related equipment. Other methods include spray drying and the like. Compounding of the modified pigment and other ingredients with the resin is generally followed by mechanical attrition and classification to provide toner particles having a desired particle size and particle size distribution. Conventional equipment for dry blending of powders may be used for mixing or blending the modified pigment particles with the resin. Again, conventional methods of preparing toner and developer compositions can be used and are described in the patents and European application described above and incorporated herein by reference.

In more detail, the toner material can be prepared by dry blending the binder resin with all other ingredients, including the pigment, and then melt-extruding in a high shear mixer to form a homogeneously mixed mass. During this process the components are held at a temperature above the melting point of the binder resin, and those components that are insoluble in the resin are ground so that their average particle size is reduced. This homogeneously mixed mass is then allowed to cool and solidify, after which it is pre-ground to an average particle size of about 100 microns. This material is then further subjected to particle size reduction until its average particle size meets the size range specification required for classification. A variety of classifying techniques may be used. The preferred type is an air classification type. By this method, particles in the ground material which are too large or too small are segregated from the portion of the material which is of the desired particle size range.

The toner composition of the present invention may be used alone in monocomponent developers or may be mixed with suitable carrier particles to form dual component developers. The carrier vehicles which can be used to form dual component developer compositions can be selected from various materials. Such materials typically include carrier core particles and core particles overcoated with a thin layer of film-forming resin to help establish the correct triboelectric relationship and charge level with the toner employed. Suitable carriers for two component toner compositions include iron powder, glass beads, crystals of inorganic salts, ferrite powder, nickel powder, all of which are typically coated with resin coating such as an epoxy or fluorocarbon resin. Examples of carrier particles and coatings that can be used and are described in the patents and European application described above and incorporated herein by reference.

The present invention is further directed to a method of imaging which includes formulating an electrostatic latent image on a negatively charged photoconductive imaging member, affecting the development thereof with toner composition comprising resin particles and modified pigment particles, and thereafter transferring the developed image onto a suitable substrate. Conventional methods of imaging can be used, such as shown in the patents and European patent application described above.

The present invention will be further clarified by the following examples which are intended to be purely exemplary of the present invention.

EXAMPLES

Example 1

Preparation of a Modified Carbon Black Product

A solution of 2.83 g of sodium nitrite in about 100 g of water was added slowly to a mixture of 200 g of carbon black, 3.95 g of concentrated HCl, 4.48 g of p-phenylenediamine and 1.8 L of water that was stirring at about 7° C. The carbon black, Regal®30 carbon black, had a surface area of 94 $m^2/g$ and a DBPA of 65 mL/100 g. After siring for about two hours, the mixture was allowed to stand overnight. The aqueous layer was decanted, and the remainder of the material was dried at 70° C. The product had attached $C_6H_4NH_2$ groups.

Example 2

Preparation of a Modified Carbon Black Product

A solution of 2.84 g of sodium nitrite in about 100 g of water was added slowly to a mixture of 200 g of carbon black, 3.94 g of concentrated HCl, 2.22 g of p-phenylenediamine, 4.34 g of 4-aminophenylpyridinium chloride and 1.8 L of water that was stirring at about 70° C. The carbon black, Regal®330 carbon black, had a surface area of 94 $m^2/g$ and a DBPA of 65 mL/100 g. After stirring for two hours, the mixture was allowed to stand overnight. The aqueous layer was decanted, and the remainder of the material was dried at 70° C. The product had attached $C_6H_4NH_2$ and $C_6H_4NC_5H_5^+Cl^-$ groups.

Example 3 (Comparative)

Preparation of a Toner

A black toner powder was prepared by the conventional technique of melt-mixing, extruding, pre-grinding, jetmilling and classifing. Thus, 8 wt % of Regal®330 carbon black (unmodified) (available from Cabot Corporation, Boston, Mass.) was dry blended with 92 wt % of Dialec 1601 styrenated acrylic polymer (available from Polytribo Inc, Bristol, Pa.) and melt-extruded in a B&P 19-millimeter extruder (available from B&P Process Equipment & Systems, LLC, Saginaw, Mich.) operating in a typical screw and paddle configuration. The resulting carbon black/polymer product was pre-ground in a Krups Mini Blender, then jetmilled and classified using a Majac A-12 and mini-grinder to form a black toner powder having an average particle size of about 13 microns, as determined using a Coulter Multisizer Particle Size Analyzer. This toner is referred to as Sample 2 in Table 1 of Example 5.

Developer compositions were prepared by mixing the toner composition described above either with a positive charging ferrite powder, or a standard ferrite powder (both available from Powdertech, Inc., Valparaiso, Ind.), in an amount sufficient to yield a 2.0 wt % loading.

Tribocharge measurements were made by tumble blending the above developer compositions (toner plus carrier) in stainless steel vessels on a roll mill. At blending times of 15 minutes, 30 minutes, 45 minutes, and 60 minutes, a small sample of the developer composition was removed and its charge-to-mass ratio (Q/M) was determined by the Faraday cage tribo blow-off method using a Vertex T-150 tribocharge tester (available from Vertex, Inc., Yukon, Pa.).

Example 4

Preparation of a Toner

A black toner powder was prepared by the conventional technique of melt-mixing, extruding, pre-grinding, jetmilling and classifying. Thus 8 wt % of the modified carbon black prepared in Example 1 was dry blended with 92 wt % of Dialec 1601 styrenated acrylic polymer (available from Polytribo Inc, Bristol, Pa.) and melt-extruded in a B&P 19-millimeter extruder (available from B&P Process Equipment & Systems, LLC, Saginaw, Mich.) operating in a typical screw and paddle configuration. The resulting carbon black/polymer product was pre-ground in a Krups Mini Blender, then jetmilled and classified using a Majac A-12 and mini-grinder to form a black toner powder having an average particle size of about 12 microns, as determined using a Coulter Multisizer Particle Size Analyzer. This toner is referred to as Sample 3 in Table 1 of Example 5.

Developer compositions were prepared by mixing the toner composition described above either with a positive charging ferrite powder, or a standard ferrite powder (both available from Powdertech, Inc., Valparaiso, Ind.), in an amount sufficient to yield a 2.0 wt % loading.

Tribocharge measurements were made by tumble blending the above developer compositions (toner plus carrier) in stainless steel vessels on a roll mill. At blending times of 15 minutes, 30 minutes, 45 minutes, and 60 minutes, a small sample of the developer composition was removed and its charge-to-mass ratio (Q/M) was determined by the Faraday cage tribo blow-off method using a Vertex T-150 tribocharge tester (available from Vertex, Inc., Yukon, Pa.).

The results of tribocharge testing of Sample 3 using a standard ferrite carrier are presented in FIG. 1. Also in FIG. 1 are shown for comparative purposes the tribocharging behavior of a pseudo toner containing a jet-milled Dialec 1601 resin which was combined with a standard ferrite carrier in an amount to yield a 2.0 wt. % loading (Sample 1) and the toner of Example 3 combined with a standard ferrite carrier in an amount to yield a 2.0 wt. % loading. After 15 minutes the charge on Sample 1 was strongly negative at about −20 microcoulombs/g, and was slightly more negative after 60 minutes. In comparison the charges at 15 minutes on Samples 2 and 3 were more than 15 microcoulombs/g more positive and were nearly equal. After 60 minutes, however, the charge on sample 2 (containing unmodified Regal®330) became more negative by more than 12 microcoulombs/g while the charge on Sample 3 (containing the modified carbon black from Example 1) decreased by less than 3 microcoulombs/g.

Figure 2:
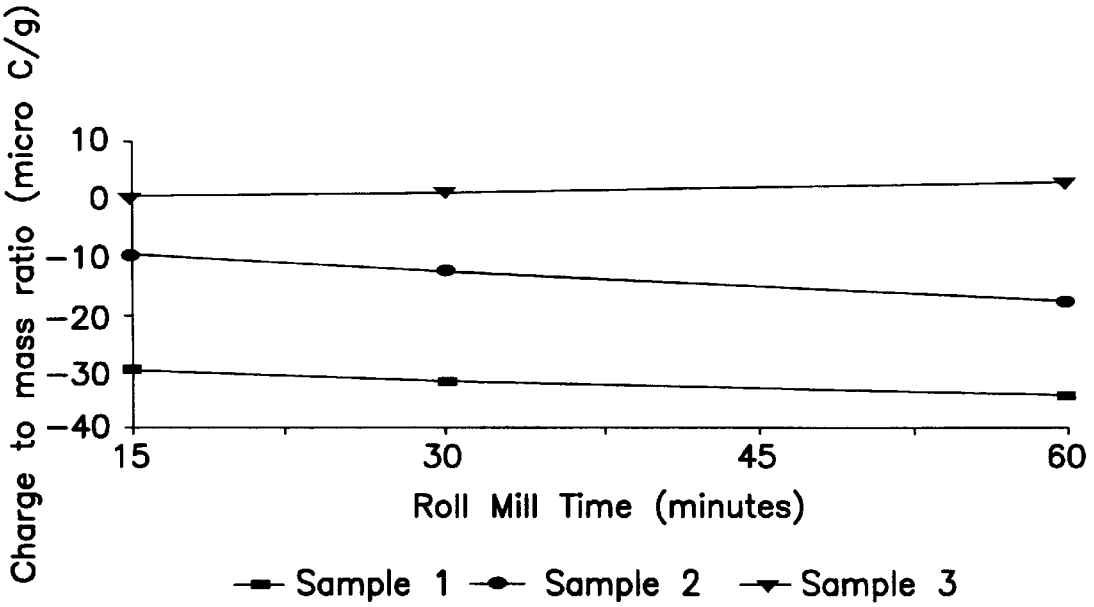
FIG. 2 is a graph (Q/M vs Roll Mill Time) showing the tribocharging behavior of dry powders, including a toner of the present invention, using a positive carrier.

The results of tribocharge testing of Sample 3 using a positive ferrite carrier are presented in FIG. 2. Also in FIG. 2 are shown for comparative purposes the tribocharging behavior of a pseudo toner containing a jetmilled Dialec 1601 resin (Sample 1) which was combined with a positive ferrite carrier in an amount to yield a 2.0 wt. % loading and the toner of Example 3 combined with a positive ferrite carrier in an amount to yield a 2.0 wt. % loading. (Sample 2). After 15 minutes the charge on Sample 1 was strongly negative, while by comparison the charge on Sample 2 was more positive by 20 microcoulombs/g, and the charge on Sample 3 was more positive by 30 microcoulombs/g. After 60 minutes the charge on Sample 2 (containing unmodified Regal®330) became more negative by about 10 microcoulombs/g, while the charge on Sample 3 (containing the modified carbon black from Example 1) actually became slightly more positive, by less than 3 microcoulombs/g.

Example 5

Preparation of a Toner

A black toner powder was prepared by the conventional technique of melt-mixing, extruding, pre-grinding, jetmilling and classifying. Thus, 8 wt % of the modified carbon black prepared in Example 2 was dry blended with 92 wt % of Dialec 1601 styrenated acrylic polymer (available from Polytribo Inc, Bristol, Pa.) and melt-extruded in a B&P 19-millimeter extruder (available from B&P Process Equipment and Systems, LLC, Saginaw, Mich.) operating in a typical screw and paddle configuration. The resulting carbon black/polymer product was pre-ground in a Krups Mini Blender, then jetmilled and classified using a Majac A-12 and mini-grinder to form a black toner powder having an average particle size of about 12 microns, as determined using a Coulter Multisizer Particle Size Analyzer. This toner is referred to as Sample 4 in Table 1 of Example 5.

Developer compositions were prepared by mixing the toner composition described above either with a positive charging ferrite powder, or a standard ferrite powder (both available from Powdertech, Inc., Valparaiso, Indiana), in an amount sufficient to yield a 2.0 wt % loading.

Tribocharge measurements were made by tumble blending the above developer compositions (toner plus carrier) in stainless steel vessels on a roll mill. At blending times of 15 minutes, 30 minutes, 45 minutes and, 60 minutes, a small sample of the developer composition was removed and its charge-to-mass ratio (Q/M) was determined by the Faraday cage tribo blow-off method using a Vertex T-150 tribocharge tester (available from Vertex, Inc., Yukon, Pa.).

Figure 3:
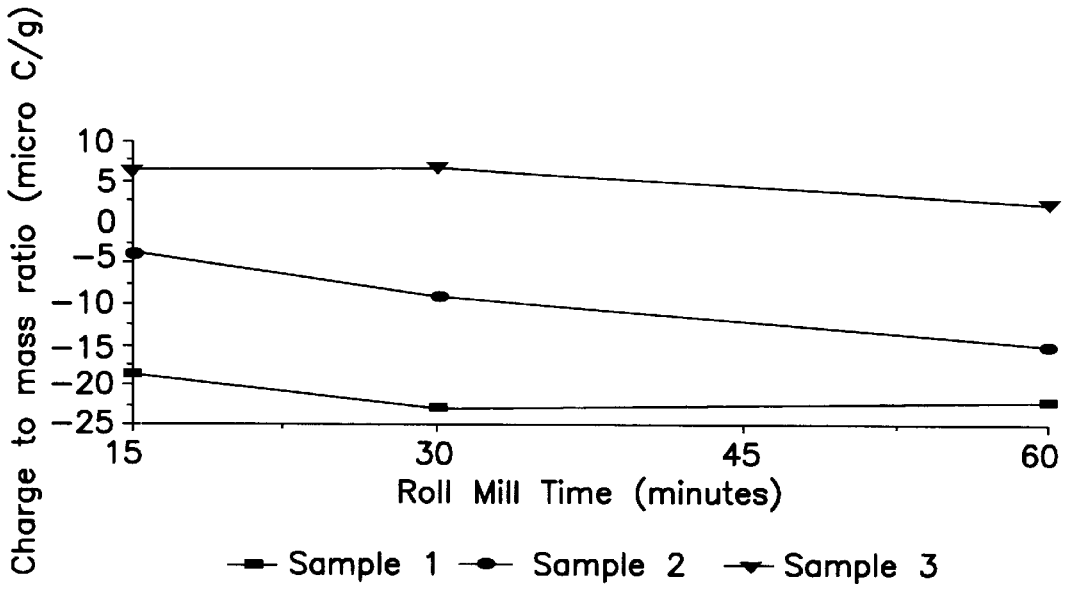
FIG. 3 is a graph (Q/M vs Roll Mill Time) showing the tribocharging behavior of dry powders, including a toner of the present invention, using a standard carrier.

The results of tribocharge testing of Sample 4 against a standard ferrite carrier are presented in FIG. 3. Also in FIG. 3 are shown for comparative purposes the tribocharging behavior of a pseudo toner containing a jet-milled Dialec 1601 resin (Sample 1) which was combined with a standard ferrite carrier in an amount to yield a 2.0 wt. % loading and the toner of Example 3 (Sample 2) which was combined with a standard ferrite carrier in an amount to yield a 2.0 wt. % loading. After 15 minutes the charge on Sample 1 was strongly negative at about −20 microcoulombs/g and was slightly more negative at 60 minutes. In comparison, the charge at 15 minutes on Sample 2 was more than 15 microcoulombs/g more positive, and the charge on Sample 4 was more than 25 microcoulombs/g more positive. After 60 minutes, however, the charge on sample 2 (containing unmodified Regal®330) became more negative by more than 12 microcoulombs/g while the charge on Sample 4 (containing the modified carbon black from Example 2) decreased by less than 3 microcoulombs/g.

Figure 4:
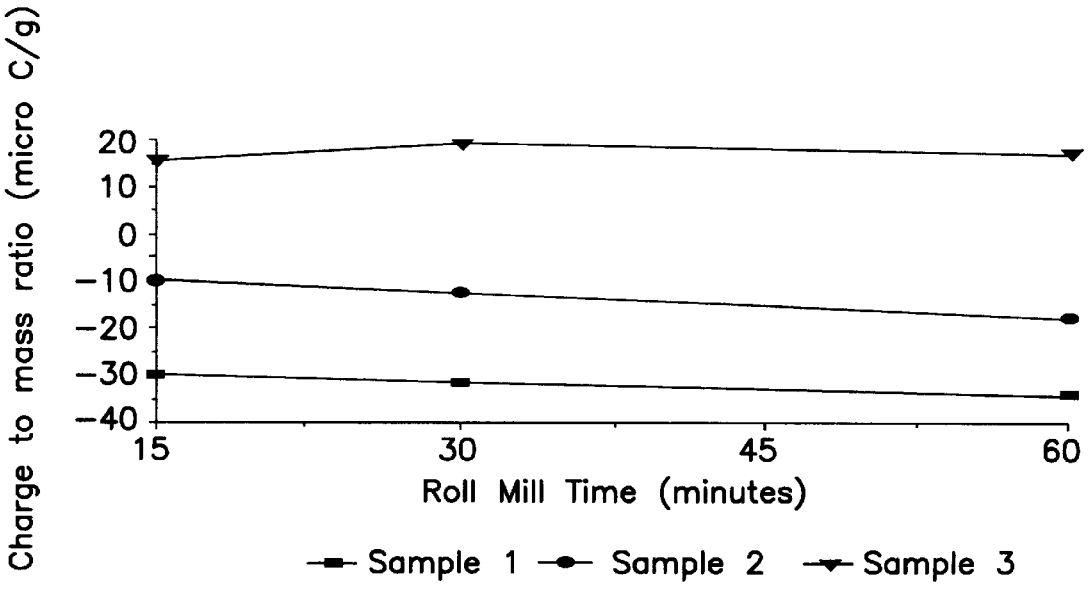
FIG. 4 is a graph (Q/M vs Roll Mill Time) showing the tribocharging behavior of dry powders, including a toner of the present invention, using a positive carrier.

The results of tribocharge testing of Sample 4 against a positive ferrite carrier are presented in FIG. 4. Also in FIG. 4 are shown for comparative purposes the tribocharging behavior of a pseudo toner containing a jet-milled Dialec 1601 resin (Sample 1) which was combined with a positive ferrite carrier in an amount to yield a 2.0 wt. % loading and the toner of Example 3 (Sample 2) which was combined with a positive ferrite carrier in an amount to yield a 2.0 wt. % loading. After 15 minutes the charge on Sample 1 is strongly negative at about -30 microcoulombs/g and is slightly more negative at 60 minutes. In comparison the charge at 15 minutes on Sample 2 was more positive by about 20 microcoulombs/g, and the charge on Sample 4 was more positive by 45 microcoulombs/g. After 60 minutes the charge on Sample 2 (containing unmodified Regal®330) became more negative by about 10 microcoulombs/g, while the charge on Sample 4 (containing the modified carbon black from Example 2) remains at about the same positive level of +15 microcoulombs/g.

TABLE 1

| Sample | Toner Composition: |
|---|---|
| 1 | Pure Dialec 1601 |
| 2 | Regal ® 330 (8 wt %)/Dialec 1601 (92 wt %) |
| 3 | Modified Carbon Black from Example 1 (8 wt %)/Dialec 1601 (92 wt %) |
| 4 | Modified Carbon Black from Example 2 (8 wt %)/Dialec 1601 (92 wt %) |

Example 6

Preparation of a Carbon Black Product

Silver nitrite (7.7 parts) was added to a solution of 11.8 parts of N-methyl-3-aminopyridinium iodide in about 50 parts of water. After stirring for one hour, the mixture was filtered and the precipitate was washed with about 100 parts of water. The liquids were combined to give a solution of N-methyl-3-aminopyridinium nitrite.

A pelletizer was charged with 500 parts of a carbon black with a surface area is of 94 $m^2/g$ and a DBPA of 65 mL/100 g and 5.6 parts of phenylenediamine. The pelletizer was run at about 400 rpm for about 30 sec. The N-methyl-3-aminopyridinium nitrite solution was added while the pelletizer was mixing, and mixing was continued for two minutes at 400 rpm. The pelletizer speed was increased to 700 rpm, and a solution of 9.1 parts concentrated $HNO_3$ in 50 parts water, 25 parts water, a solution of 3.6 parts $NaNO_2$ in 50 parts water, and then 30 parts water were added successively with two minutes following each addition. The resulting product was dried under vacuum at 55° C. The product had attached $C_6H_4NH_2$ and $C_5H_4NCH_3^+NO_3^-$ groups.

Example 7

Preparation of a Carbon Black Product

A solution of 2.1 g of nitric acid in 30 g of water was gradually added to a suspension of 19.5 g of N-(4-aminophenyl)pyridinium nitrite, 200 g of carbon black and 1 L of water that was stirring at about 65° C. The carbon black had a surface area of 94 $m^2/g$ and a DBPA of 65 mL/100 g. After stirring for an additional 50 min, the product was dried in an oven at 76° C. The product had attached $C_6H_4NC_5H_5^+NO_3^-$ groups.

Example 8

Preparation of a Carbon Black Product

A pelletizer was charged with 500 parts of a carbon black with a surface area of 94 $m^2/g$ and a DBPA of 65 mL/100 g, 2.9 parts of p-phenylenediamine and 5.2 parts of N-(4-aminophenyl)pyridinium chloride. The pelletizer was run at about 400 rpm for about two min. As the pelletizer continued to run, a solution of 5.0 parts concentrated HCl in about 125 parts water, about 25 parts water, a solution of 3.6 parts of $NaNO_2$ in about 125 parts of water and about 25 parts of water were added in succession. Mixing was continued at 700 rpm for an additional six minutes. The resulting product was dried at 65° C. The product had attached $C_6H_4NH_2$ and $C_6H_4NC_5H_5^+Cl$ groups.

Example 9

Preparation of a Carbon Black Product

A pelletizer was charged with 400 parts of a carbon black with a surface area of 94 $m^2/g$ and a DBPA of 65 mL/100 g and 7.6 parts of 3-aminopyridine. The pelletizer was run at about 200 rpm for about one min. A solution of 7.2 parts of concentrated nitric acid in about 50 parts of water was heated to about 55° C. and then added to the pelletizer while it was mixing at 400 rpm. The mixing was continued for about one minute. As the pelletizer continued to run, a solution of 5.7 parts of $NaNO_2$ in about 50 parts of water at 60° C. was added followed by 100 parts of 65° C. water. The resulting product was dried under vacuum at 70° C. The product had attached $C_5H_4N$ groups.

Example 10

Preparation of a Carbon Black Product

A pelletizer was charged with 800 parts of a carbon black with a surface area of 94 $m^2/g$ and a DBPA of 65 mL/100 g and 30 parts of 4'aminoacetanilide. The pelletizer was run at about 400 rpm for about one min. The pelletizer speed was increased to 700 rpm and a solution of 19.,8 parts concentrated HCl in about 165 parts water, about 55 parts water, a solution of 13.9 parts of $NaNO_2$ in about 165 parts of water, and about 130 parts of water were added in succession with one to two minutes after each addition. The resulting material was boiled in 3.5 L of 5 M HCl overnight, cooled and filtered. After washing three times with 3.5 L of water, once with 4 L of ethanol and once with 5 L of water, the product was dried under vacuum. The product had attached $C_6H_4NH_3{+}Cl^-$ groups.

Example 11

Preparation and Evaluation of a Toner

The carbon black product of Example 6 was incorporated into a pseudo toner and evaluated using the method of Example 4. After rolling for 60 minutes with a positive carrier, a toner incorporating the carbon black product of Example 6 had a tribocharge of 16 $_\mu$C/g. A control toner that had Regal 330 carbon black incorporated in it gave a tribocharge of 1 $_\mu$C/g against the same carrier.

Example 12

Preparation and Evaluation of Toners

Black toners were prepared by the conventional technique of melt-mixing, extruding, pregrinding, jetmilling and classifying. Thus, 8 parts of carbon black and 92 parts of Dialec 1601 styrenated acrylic polymer were melt extruded with a Werner and Pfleiderer ZSK-30 twin screw extruder. The resulting black/polymer product was granulated in a Kayness mini granulator, and then jetmilled and classified using a Hosokawa Alpine AFG Model 100 mill to form a black toner powder having an average particle size of about 8 microns, as determined using a Coulter Multisizer II.

Developer compositions were prepared by mixing the toner composition with a positive charging (Type 13) carrier available from Vertex in an amount sufficient to yield a 2.0 wt % loading. Tribocharge measurements were made by tumble blending the developer compositions (toner plus carrier) in glass vessels on a roll mill. After blending for 60 minutes, a small sample of the developer composition was removed and its charge to mass ratio (Q/M) was determined by the Faraday cage blow off method using a Vertex T-150 tribocharge tester. The results shown below indicate that the samples charged more positively than the control.

| Carbon black example | Tribocharge, $_\mu$C/g |
|---|---|
| 7 | 14 |
| 8 | 13 |
| 9 | 17 |
| 10 | 21 |
| Regal 330 control | 4 |

Example 13

Preparation and Evaluation of Toners

The carbon black product of Example 9 and Regal 330 carbon black were incorporated into toners using the method of Example 12 using blends of the two carbons. The total carbon content was 4 parts and the resin content was 96 parts. These results show that the toners containing the carbon black product of Example 9 charged more positively than the toner containing only the control black.

| Example 9 Parts | Regal 330 Parts | Dialec 1601 Parts | Tribocharge $_\mu$C/g |
|---|---|---|---|
| 4 | 0 | 96 | 24 |
| 2 | 2 | 96 | 30 |
| 0 | 4 | 96 | 13 |

Example 14

Preparation of a Carbon Black product

Silver nitrite (7.7 parts) was added to a solution of 13.9 parts of 4-aminophenyltrimethyl-ammonium iodide in 40 parts of water. After stirring for three hours, the mixture was filtered and the precipitate was washed with 60 parts of water. The liquids were combined to give a solution of 4-aminophenyltrimethylammonium nitrite.

A pelletizer was charged with 500 parts of a carbon black with a surface area of 94 $m^2/g$ and a DBPA of 65 mL/100 g and 5.6 parts of phenylenediamine. The pelletizer was run at about 400 rpm for about 30 sec. The 4-aminophenyltrimethylammonium nitrite solution was added while the pelletizer was mixing, and mixing was continued for two minutes at 400 rpm. The pelletizer speed was increased to 700 rpm, and a solution of 9.1 parts concentrated $HNO_3$ in 75 parts water, 30 parts water, a solution of 3.6 parts $NaNO_2$ in 75 parts water, and then 30 parts water were added successively with two minutes following each addition. The resulting product was dried under vacuum at 55° C. The product had attached $C_6H_4NH_2$ and $C_6H_4N(CH_3)_3^+NO_3^-$ groups.

The carbon black product of this Example was incorporated into a pseudo toner and evaluated using the method of Example 4. After rolling for 60 minutes with a positive carrier, a toner incorporating the carbon black product of this Example had a tribocharge of 2 $_\mu$C/g. A control toner that had Regal 330 carbon black incorporated in it gave a tribocharge of 1 $_\mu$C/g against the same carrier.

Other embodiments of the present invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A toner composition comprising a) styrenic polymer-based resin particles and b) modified pigment particles having attached at least one organic group wherein said organic group is positively chargeable and comprises at least one aromatic group or a $C_1$–$C_{20}$ alkyl group which is attached to the pigment particles, wherein said organic group has the formula:

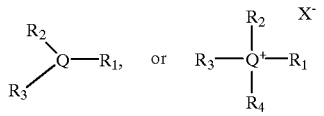

or said organic group is —$C_6H_4NH_2$, —$C_5H_4(NC_5H_5)^+X^-$ or both wherein Q represents the elements nitrogen or phosphorus; X represents a counterion; $R_1$ represents an alkylene group or an arylene group attached to the pigment; and $R_2$, $R_3$, and $R_4$, which may be the same or different, each represent an alkyl group or an aryl group or form a ring.

2. The toner composition of claim 1, wherein said organic group has the formula:

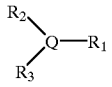

wherein Q represents the elements nitrogen or phosphorus; $R_1$ represents an alkylene group or an arylene group attached to the pigment; and $R_2$ and $R_3$, which may be the same or different, each represent an alkyl group or an aryl group or form a ring.

3. The toner composition of claim 1, wherein said organic group has the formula:

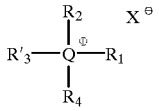

wherein Q represents the elements nitrogen or phosphorus; X represents a counterion; $R_1$ represents an alkylene group or an arylene group attached to the pigment; and $R_2$, $R_3$, and $R_4$, which may be the same or different, each represent an alkyl group or an aryl group or form a ring.

4. A developer composition comprising a toner composition of claim 1 and carrier particles.

5. The developer composition of claim 4, wherein said organic group has the formula:

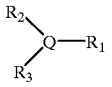

wherein Q represents the elements nitrogen or phosphorus; $R_1$ represents an alkylene group or an arylene group attached to the pigment; and $R_2$ and $R_3$,which may be the same or different, each represent an alkyl group or an aryl group or form a ring.

6. The developer composition of claim 4, wherein said organic group has the formula:

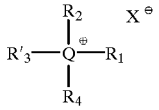

wherein Q represents the elements nitrogen or phosphorus; X represents a counterion; $R_1$ represents an alkylene group or an arylene group attached to the pigment; and $R_2$, $R_3$, and $R_4$, which may be the same or different, each represent an alkyl group or an aryl group or form a ring.

7. A method of imaging comprising formulating an electrostatic latent image on a negatively charge photoconductive imaging member, affecting the development thereof with a toner composition of claim 1, and transferring the developed image onto a substrate.

8. The method of claim 7, wherein said organic group has the formula:

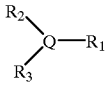

wherein Q represents the elements nitrogen or phosphorus; $R_1$ represents an alkylene group or an arylene group attached to the pigment; and $R_2$ and $R_3$, which may be the same or different, each represent an alkyl group or an aryl group or form a ring.

9. The method of claim 7, wherein said organic group has the formula:

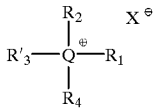

wherein Q represents the elements nitrogen or phosphorus; X represents a counterion; $R_1$ represents an alkylene group or an arylene group attached to the pigment; and $R_2$, $R_3$, and $R_4$, which may be the same or different, each represent an alkyl group or an aryl group or form a ring.

10. A toner composition comprising a) styrenic polymer-based resin particles and b) modified pigment particles having attached at least one organic group wherein said organic group is positively chargeable and comprises at least one aromatic group or a $C_1$–$C_{20}$ alkyl group which is attached to the pigment particles, wherein said organic group is —$C_5H_4N$ or —$C_5H_4N(CH_3)^+X^-$ or comprises a pyridyl group, wherein X represents a counterion.

11. The toner composition of claim 10, further comprising a modified pigment particle having attached —$C_5H_4N(CH_3)^+X^-$ or —$C_6H_4(NC_5H_5)^+X^-$, wherein $X^-$ is a counterion group.

12. The toner composition of claim 1, wherein said organic group is —$C_5H_4N(CH_3)^+X^-$ wherein X' is a counterion.

13. The toner composition of claim 12, further comprising modified pigment particles having attached —$C_6H_4NH_2$ groups.

14. A developer composition comprising the toner composition of claim 10 and carrier particles.

15. A developer composition comprising the toner composition of claim 12 and carrier particles.

16. The toner composition of claim 10, wherein said organic group comprises a pyridyl group.

17. A developer composition comprising the toner composition of claim 16 and carrier particles.

18. The toner composition of claim 1, wherein the counterion is Cl—, $NO_3^-$, $Br^-$, or $ArSO_3^-$.

19. The developer composition of claim 4, wherein the counterion is Cl—, $NO_3^-$, $Br^-$, or $ArSO_3^-$.

20. The toner composition of claim 10, wherein said organic group comprises a pyridyl group and further comprises a modified pigment particle having attached an organic group comprising a quaternary ammonium group.

21. The toner composition of claim 1, wherein said organic group is —$C_6H_4NH_2$, —$C_6H_4(NC_5H_5)^+X^-$ or both, where $X^-$ is a counterion.

22. The developer composition of claim 14, wherein said organic group is —$C_6H_4NH_2$, —$C_6H_4(NC_5H_5)^+X^-$ or both, where $X^-$ is a counterion.

23. A method of imaging comprising formulating an electrostatic latent image on a negatively charge photoconductive imaging member, affecting the development thereof with a toner composition of claim 1, and transferring the developed image onto a substrate.

24. The method of claim 7, wherein said organic group is —$C_6H_4NH_2$, —$C_6H_4(NC_5H_5)^+X^-$ or both, where X is a counterion.

25. The toner composition of claim 1, wherein said aromatic or $C_{1-20}$ alkyl group is directly attached to said pigment.

26. The developer composition of claim 4, wherein said aromatic or $C_{1-20}$ alkyl group is directly attached to said pigment.

27. The method of claim 23, wherein said aromatic or $C_{1-20}$ alkyl group is directly attached to said pigment.

* * * * *